US006540323B1

(12) United States Patent
Dowell et al.

(10) Patent No.: US 6,540,323 B1
(45) Date of Patent: Apr. 1, 2003

(54) SNOUT-ENCOMPASSING CAPPING SYSTEM FOR INKJET PRINTHEADS

(75) Inventors: Daniel D. Dowell, Albany, OR (US); Louis C. Barinaga, Salem, OR (US); Kit L. Harper, Vancouver, WA (US); Jeremy A. Davis, Battle Ground, WA (US); David J. Waller, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/066,113

(22) Filed: Jan. 31, 2002

(51) Int. Cl.[7] ..... B41J 21/165
(52) U.S. Cl. ..... 347/29
(58) Field of Search ..... 347/22, 29

(56) References Cited

U.S. PATENT DOCUMENTS 6,371,672 B1 * 4/2002 Pirie et al. ..... 347/19

FOREIGN PATENT DOCUMENTS

JP 4-94943 * 3/1992 ..... 347/29

* cited by examiner

*Primary Examiner*—Huan Tran

(57) ABSTRACT

The present invention includes as one embodiment a capping station for a fluid ejection device having a snout feature, the capping station comprising a cap with a rigid body and a gland seal disposed around an inner perimeter of a cavity defined by the rigid body for resiliently receiving side portions of the snout feature of the fluid ejection device to create a seal with the fluid ejection device.

37 Claims, 6 Drawing Sheets

SNOUT-ENCOMPASSING CAPPING SYSTEM FOR INKJET PRINTHEADS

FIELD OF THE INVENTION

One embodiment of the present invention generally relates to inkjet printing mechanisms, and in particular, to a capping system and method for use in inkjet capping stations.

BACKGROUND OF THE INVENTION

Cleaning and protecting an inkjet printhead assembly is an important aspect relating to proper maintenance of an inkjet printing mechanism, such as a printer or a plotter. Typically, inkjet printing mechanisms include a service station mechanism that is mounted within the printer chassis for cleaning and protecting the inkjet printhead assembly. In operation, the printhead assembly is moved over the station to allow certain predefined maintenance operations to be performed.

A capping station is usually included in a service station and used during storage or non-printing periods. Namely, the capping system is designed to substantially seal the printhead assembly nozzles from contaminants and to prevent ink drying in the printhead assembly. Many capping stations use an elastomeric cap that is pressed against the printhead assembly to create a hermetic seal.

However, current cap designs require too much area in the plane of the printhead assembly orifice plate. Consequently, certain components of the printhead assembly, such as the substrate that contains the ink ejection elements, need to be larger than if the area for the capping seal was smaller or not required. Thus, the unnecessary sealing area used by current capping stations can increase printhead assembly manufacturing costs as the cost for substrate material, such as silicon, increases with size.

In addition, current capping stations typically push the caps tightly against the orifice plate of the printhead assembly until a seal around the printhead assembly nozzles is achieved. This tight seal is used to discourage the evaporation of ink. However, a tight seal usually requires a relatively large amount of force, which could unseat the printhead assembly from its respective datum plane, thereby changing the alignment of the printhead assembly. Hence, in addition to the above problems with current capping stations, they are also not sensitive to variations in cap force.

SUMMARY OF THE INVENTION

The present invention includes as one embodiment a capping station for a fluid ejection device having a snout feature, the capping station comprising a cap with a rigid body and a gland seal disposed around an inner perimeter of a cavity defined by the rigid body for resiliently receiving side portions of the snout feature of the fluid ejection device to create a seal with the fluid ejection device.

BRIEF DESCRIPTION OF THE DRAWINGS

The present invention can be further understood by reference to the following description and attached drawings that illustrate the preferred embodiments. Other features and advantages will be apparent from the following detailed description of the preferred embodiment, taken in conjunction with the accompanying drawings, which illustrate, by way of example, the principles of the invention.

DETAILED DESCRIPTION OF THE PREFERRED EMBODIMENTS

In the following description of the invention, reference is made to the accompanying drawings, which form a part hereof, and in which is shown by way of illustration a specific example in which the invention may be practiced. It is to be understood that other embodiments may be utilized and structural changes may be made without departing from the scope of the present invention, as defined by the claims appended below.

Figure 1:
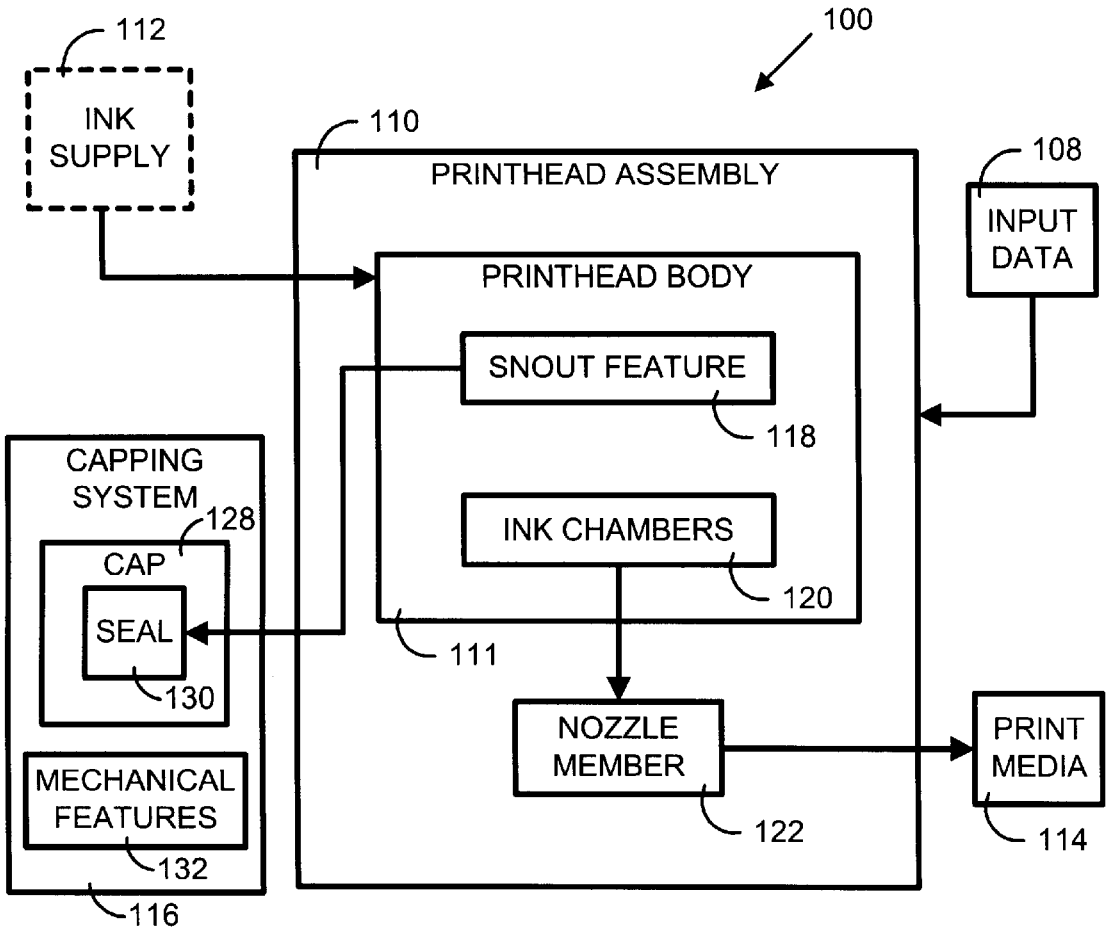
FIG. 1 is one embodiment showing a block diagram of an overall printing system.

I. General Overview:

FIG. 1 shows a block diagram of an overall printing system of one embodiment. The printing system includes input data 108, a printhead assembly 110 with a printhead body 111, an ink supply 112 (shown in dotted lines because it can be located either remotely from or integrated with the printhead assembly 110), print media 114 and a capping system 116. The printhead body also includes a snout feature 118 that removeably couples to the capping system 116.

During a printing operation, ink is provided from the ink supply 112 to an interior portion (such as an ink reservoir) of the printhead body 111. The interior portion of the printhead body 111 provides ink through ink channels and chambers 120 to a nozzle member 122. Namely, the printhead assembly 110 receives commands and input data 108 from a processor (not shown) to print ink and form a desired pattern for generating text and images on the print media 114.

When the printhead assembly is not printing, the snout feature 118 is securely coupled to the capping system 116. The capping system includes a cap 128 with a rigid body and an overmolded gland seal 130 disposed around an inner perimeter of a cavity of the rigid body for resiliently receiving side portions of the snout feature of the printhead assembly to create an out of plane seal with the printhead assembly (discussed in detail below with reference to FIG. 4). The cross-section of the gland seal is preferably circular and mates with the snout feature 118. This mating creates sealing forces orthogonal to each side of the snout feature 118, respectively. In this arrangement, the sealing forces are mutually opposing, thereby decreasing the capping force used to mate the snout feature 118 with the capping system 116, and thus, will not unseat the printhead assembly 110 from its respective datum planes. In addition, this capping system 116 allows for a smaller, and therefore cost effective, silicon printhead. Further, this capping system 116 eliminates the need for secondary or "in plane" capping surfaces sealing against the nozzle orifice plate.

The capping system can also alternatively include several other mechanical features 132. Namely, it can include an angled seal that is notched in a horizontal plane to allow greater accommodation of sealing forces (discussed in detail below with reference to FIGS. 5 and 6). This also decreases the likelihood of contamination by ink path drooling. The angled seal can also be notched in a vertical plane to accommodate air pressure increase during the capping process or during changes in environmental conditions. These mechanical features control capping forces while maintaining a seal when capped. The uniform seal decreases evaporation of ink, and radially acting forces facilitate a more uniform seal.

Figure 2:
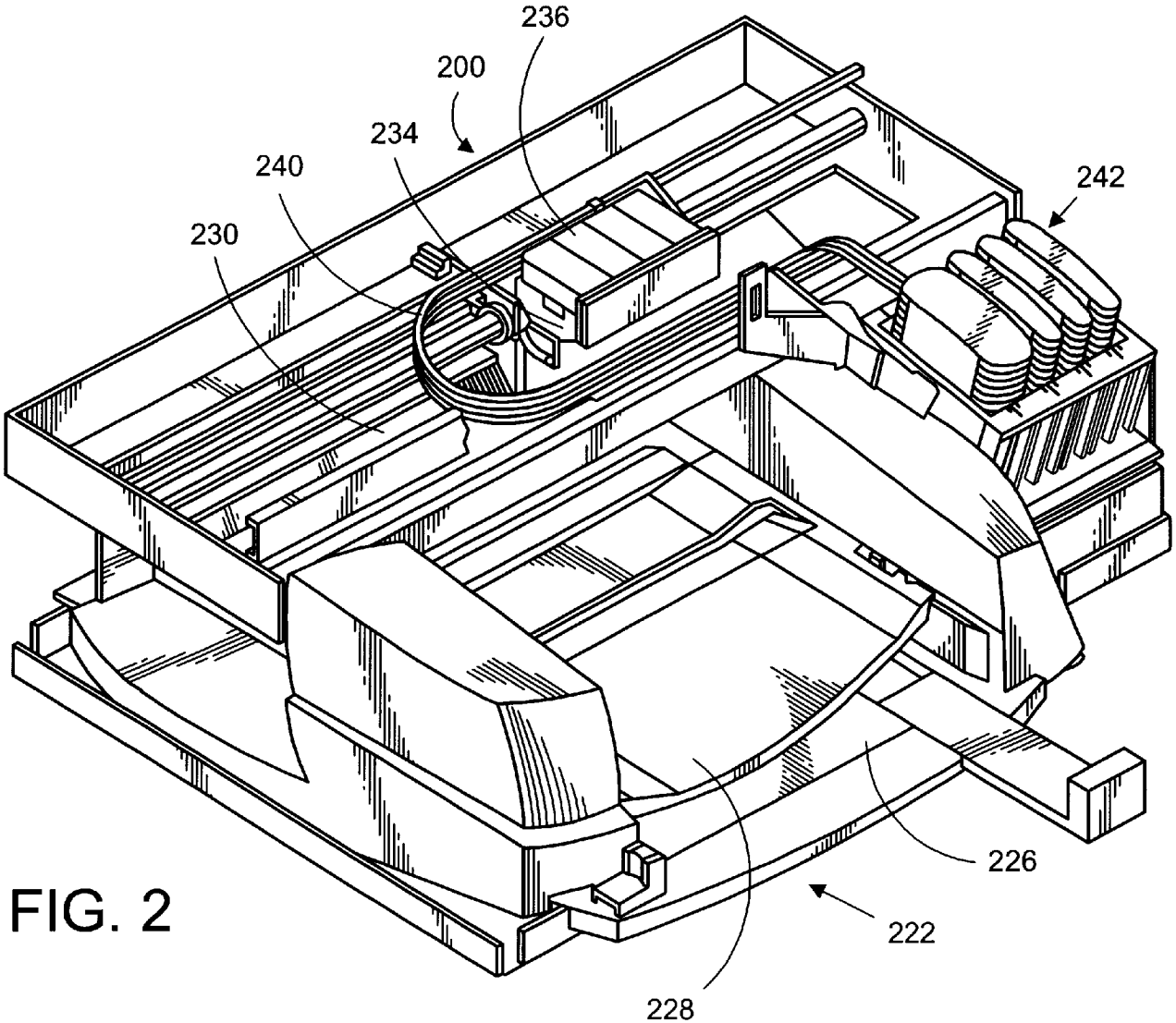
FIG. 2 is one embodiment showing an exemplary inkjet printing mechanism, here a printer that incorporates one embodiment of the invention is shown for illustrative purposes only.

II. Exemplary Printing System:

FIG. 2 is one embodiment of an exemplary inkjet printing mechanism here a high-speed printer that incorporates an embodiment of the invention, which is shown for illustrative purposes only. Generally, printer 200 can incorporate the printhead assembly 110 of FIG. 1 and further include a tray 222 for holding print media. When printing operation is initiated, print media, such as paper, is fed into printer 200 from tray 222 preferably using sheet feeder 226. The sheet is then brought around in a U turn and then travels in an opposite direction toward output tray 228. Other paper paths, such as a straight through paper path, can also be used.

The sheet is stopped in a print zone 230, and a scanning carriage 234, supporting one or more printhead assemblies 236, is scanned across the sheet for printing a swath of ink thereon. After a single scan or multiple scans, the sheet is then incrementally shifted using, for example a stepper motor or feed rollers to a next position within the print zone 230. Carriage 234 again scans across the sheet for printing a next swath of ink. The process repeats until the entire image sheet has been printed, at which point the sheet is ejected into the output tray 228.

The print assemblies 236 can be removeably mounted or permanently mounted to the scanning carriage 234. Also, the printhead assemblies 236 can have self-contained ink reservoirs as the ink supply 112 of FIG. 1. Alternatively, each print cartridge 236 can be fluidically coupled, via flexible conduit s 240, to one of a plurality of fixed or removable ink containers 242 acting as the ink supply 112 of FIG. 1.

Figure 3:
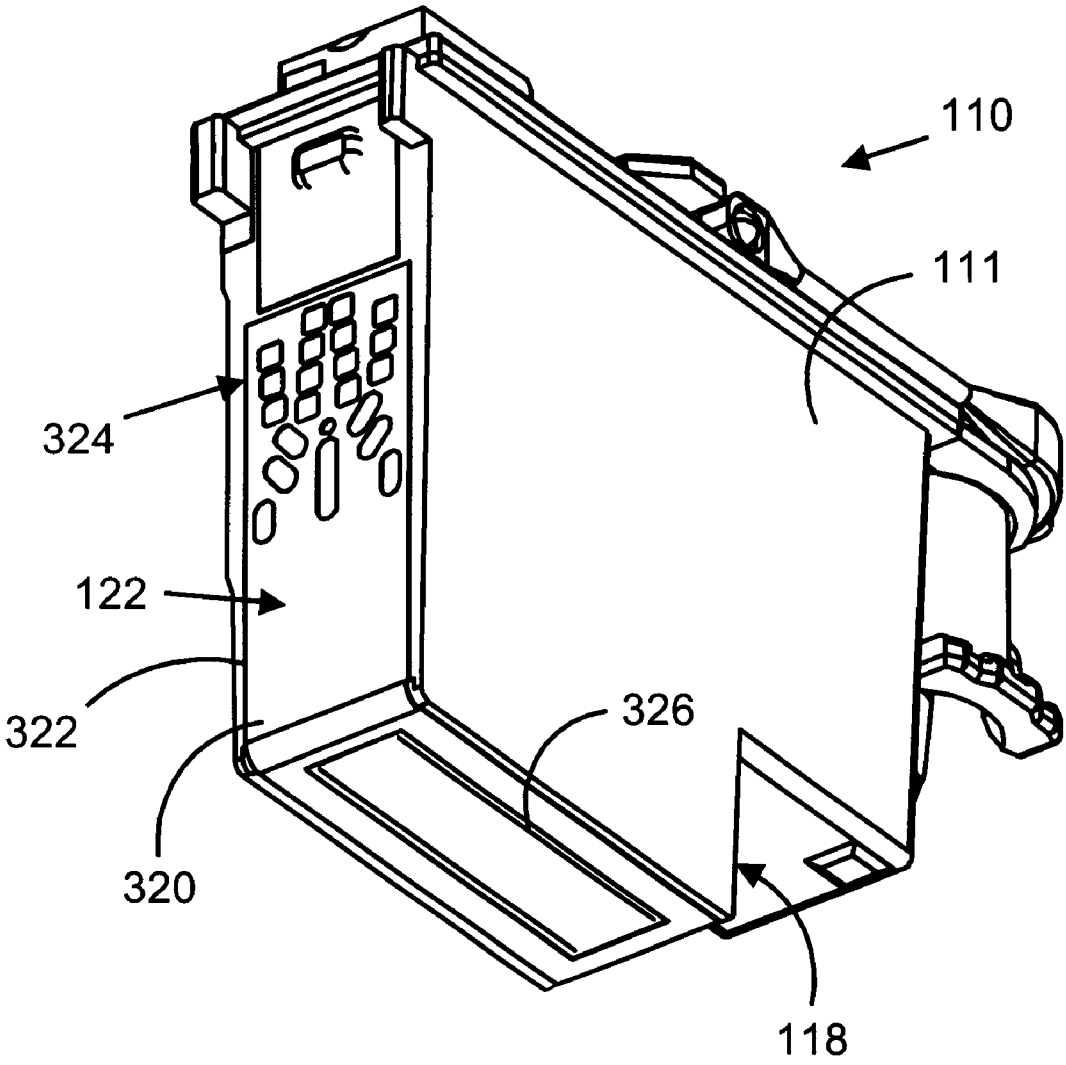
FIG. 3 is one embodiment showing for illustrative purposes only a perspective view of an exemplary inkjet print cartridge with a printhead assembly supported by a snout feature.

FIG. 3 is one embodiment that shows for illustrative purposes only a perspective view of an exemplary inkjet print cartridge (an example of the printhead assembly 110 of FIG. 1), although other printhead and printer configurations may be employed depending upon the particular implementation at hand.

Referring to FIGS. 1 and 2 along with FIG. 3, the printhead assembly 110 is comprised of the printhead body 111 with the nozzle member 122 located on the snout feature 118. The printhead assembly 110 includes a flexible circuit 320, which can be a flexible material commonly referred to as a Tape Automated Bonding (TAB) circuit bonded to the printhead assembly 110 via a coverlayer 322. The flexible circuit 320 also includes an interconnect area 324 with interconnect contact pads that align with and electrically contact electrodes (not shown) on carriage 234 of FIG. 2. The illustrated printhead assembly 110 has a snout feature 118 that terminates in an orifice plate 325 that defines a printhead plane.

Circuitry within the flexible circuit 320 preferably includes digital circuitry that communicates via electrical signals for controlling firing of ink ejection elements (not shown) associated with plural orifices or nozzles 326. The nozzles 326 are formed through the orifice plate 325, by for example, laser ablation, for creating ink drop generation. In the illustrated embodiment of a thermal inkjet printhead, one or more resistors are energized to cause ink in the printhead to form a bubble which bursts through an associated nozzle. Other inkjet printhead technologies, such as piezo-electric printheads may also be employed.

III. Component Details

Figure 4:
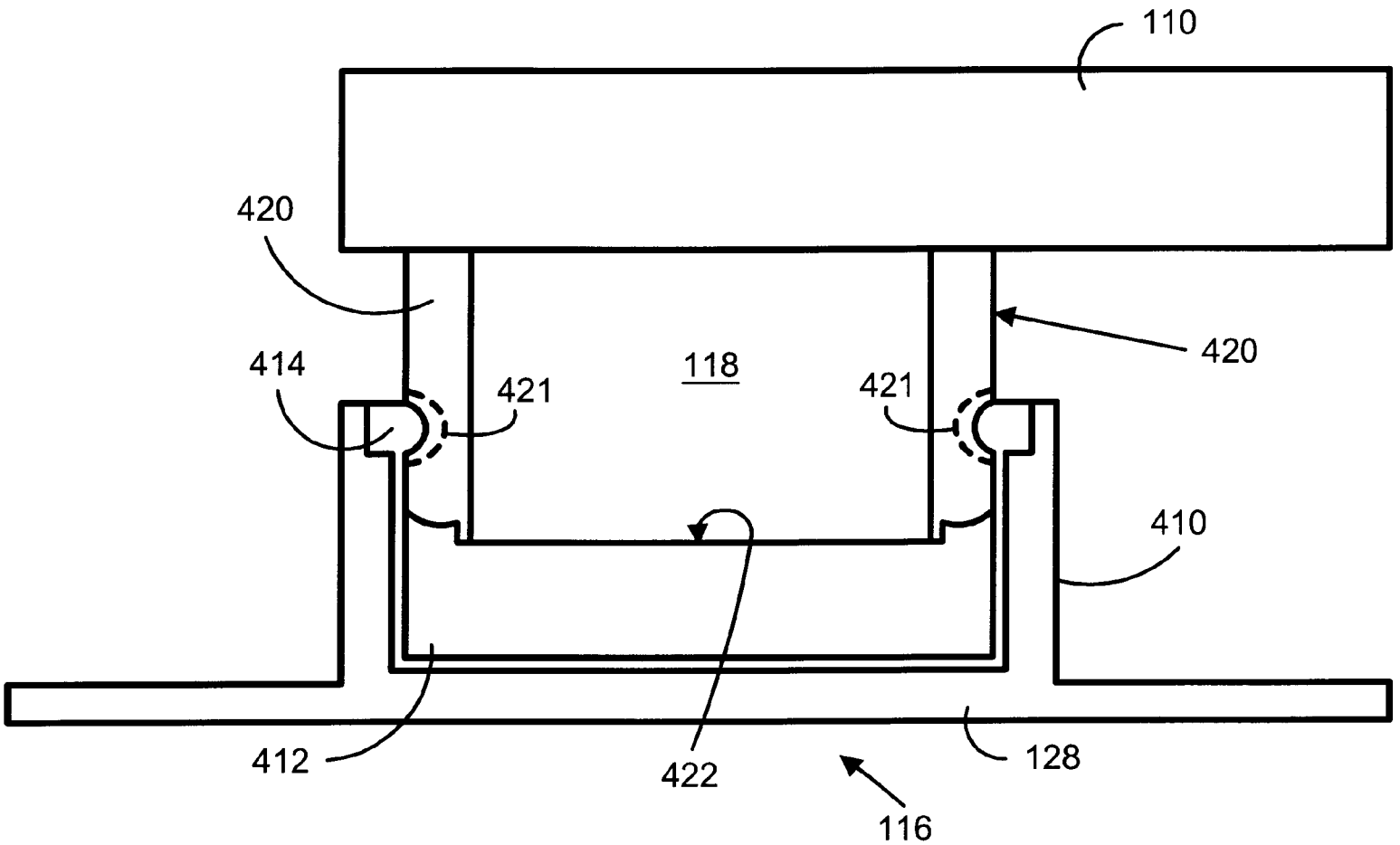
FIG. 4 is one embodiment showing for illustrative purposes only a cross sectional side view of the capping feature with one form of an overmolded gland seal.

FIG. 4 is one embodiment showing for illustrative purposes only a cross sectional side view of the capping feature with the gland seal and the snout feature 118 in an engaged state with the capping system 116. The capping system 116 is comprised of a rigid body 410, preferably manufactured with conventional injection molding techniques, coupled to an inner feature 412. The inner feature 412 includes a gland seal 414 (similar to seal 130). The inner feature 412 and the gland seal 414 are preferably overmolded to form a soft elastomeric feature onto and within the inner walls of the rigid body. A preferred range for the softness of the overmolded feature is 30–80 on the Shore A durometer scale, with a more preferred range being 50–7- on the Shore A scale.

Alternatively, the gland seal 414 can also be a separate soft elastomeric feature that is bonded to the inner wall 410. The gland seal 414 has a circular cross-section that extends around the inner perimeter of the rigid body 410. The overall shape of the gland seal 414 preferably matches the shape of the snout feature 118. The gland seal 414 can have an overall shape that is elliptical, oval, rectangular with rounded corners, square with rounded corners, etc.

The gland seal 414 is preferably made of a soft elastomer and the seal is created by capturing a piece of the soft elastomer between the sides 420 of the snout feature 118 and the seal 414, whereby the difference in radial dimensions are smaller than the cross section of the seal. For example, the cross section of the seal 414 is approximately 1 millimeter in an uncompressed state 421 (shown not to scale with dotted lines) with a diametric compression of approximately 29%. By mating the sides 420 of the snout feature 118 and the gland seal 414, the seal is captured in a volume that has a smaller dimension than the cross sectional diameter of the seal in uncompressed state, as shown in dashed lines in FIG. 4.

In particular, the mating of the parts squeezes the seal between the parts, creating a sealing force. Consequently, the seal is created without the need for forces orthogonal to the sealing plane to hold the parts together. This is in contrast to current capping systems that seal against the orifice plate 325 of the snout feature to the cap. This allows mating with a smaller sized printhead assembly 110, which makes the system cost effective, as well as accommodating printhead assemblies with varying geometries.

Figure 5:
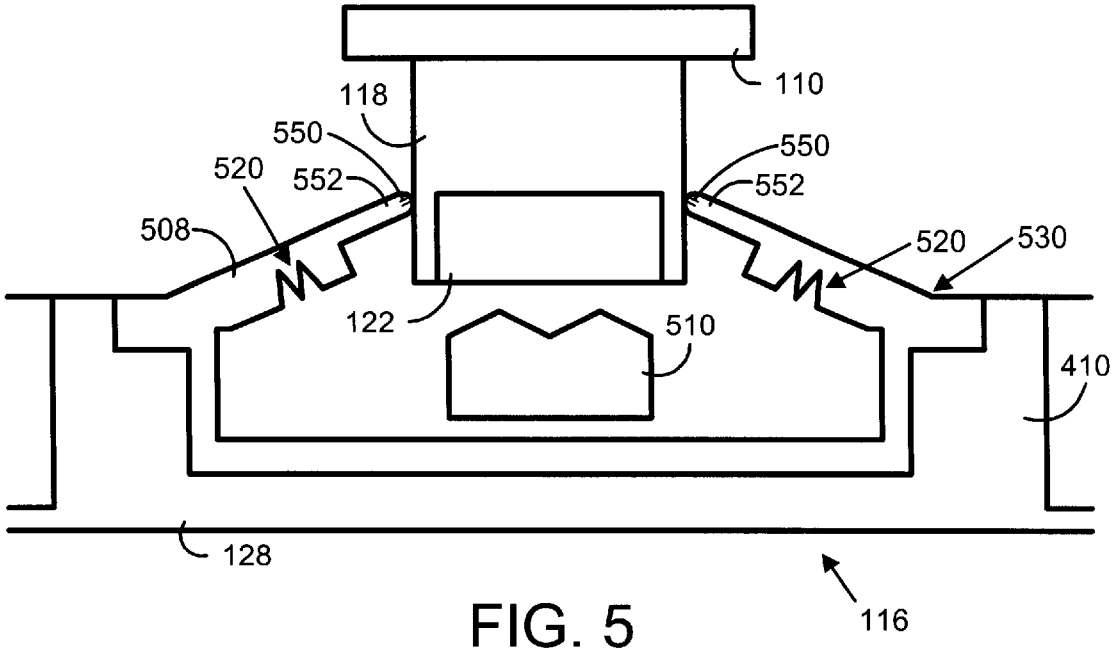
FIG. 5 is an alternative embodiment showing for illustrative purposes an angled seal with notches in an uncapped position.

FIG. 5 is an alternative embodiment showing for illustrative purposes an angled sealing lip 508 with notches in an uncapped position. The angled seal 508 is one of the mechanical features 132 of FIG. 1. The seal 508 has plural notches 520 and is preferably molded at an angle 530 to allow bending and compressing of the seal 508 as the notches 520 collapse during capping. As a result, the seal 508 facilitates sealing of the printhead assembly 110 during the capping process.

Figure 6:
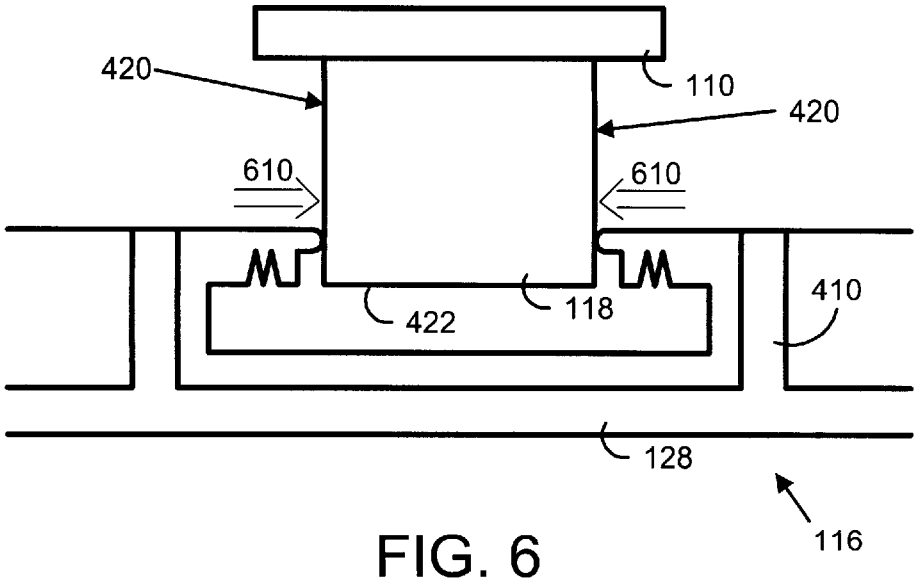
FIG. 6 is an alternative embodiment showing for illustrative purposes an angled seal with notches in a capped position.

FIG. 6 is an alternative embodiment showing for illustrative purposes an angled seal with notches in a capped position after the capping process has taken place. The notches 520 compress during engagement and allow the seal 508 to resiliently contact the sides 420 of the snout feature 118. This minimizes vertical (in relation to the horizontal orientation of the orifice plate 325) pressure against the printhead assembly 110 and in turn, vertical pressure on the carriage 234 of the printer 200 of FIG. 2. The force 610 from the cap 128 acting against the snout feature 118 is translated from a vertical direction to a horizontal direction until the capping process is completed. Moreover, the opposing forces supplied on each side of the snout cancel one another out as indicated by arrows 610 to minimize the chances of unseating the printhead assembly 110 during capping.

Both embodiments not only eliminate the force exerted against the nozzles 122 of the printhead assembly 110, they also direct the force to the sides 420 of the snout feature 118 rather than its face 325. Since the forces are applied radially, the force can be higher to ensure an adequate seal. In addition, the shape of seal 414 and 508 reduces the likelihood of being in the path of ink that has escaped from the printhead assembly 110.

Figure 7A:
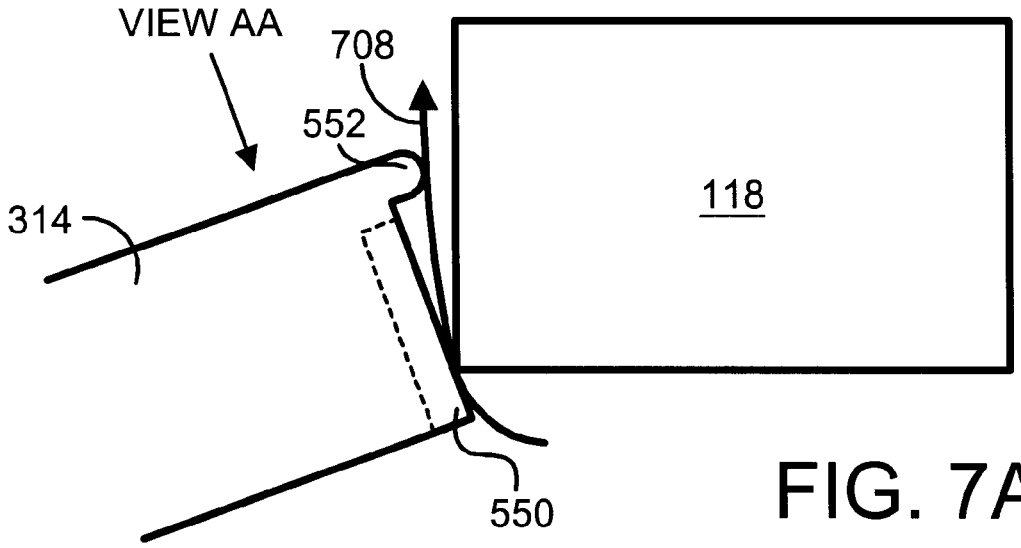
FIG. 7A is an alternative embodiment showing for illustrative purposes a seal with a vent path with notched vent channels.
Figure 7B:
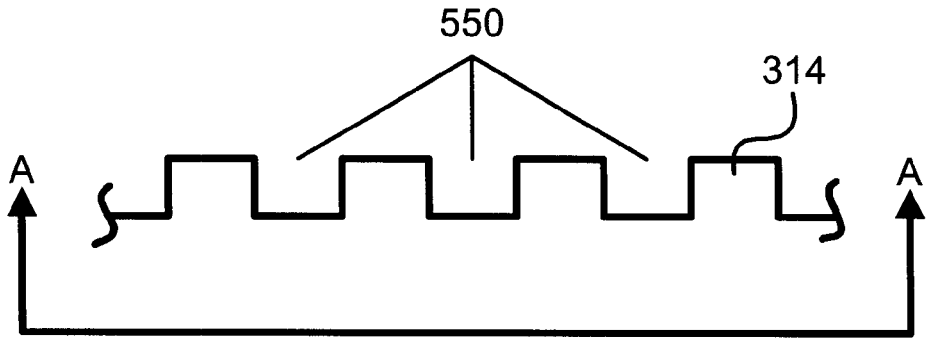
FIG. 7B is a partial view of seal taken from view M of FIG. 7A.

FIG. 7A is an alternative embodiment showing for illustrative purposes a seal with a vent path with notched vent channels. FIG. 7B is a partial view of seal taken from view AA of FIG. 7A. Referring to FIGS. 5 and 6 along with FIGS. 7A and 7B, the vent path, configured as notched channels 550, can be incorporated at an edge 552 of the seal that contacts with the snout feature 118. The notched vent channels 550 allow air pressure 510, compressed as the snout feature 118 engages with the seal 508, to escape (as shown by arrow 708) prior to the edge of the seal 552 contacting the snout feature 118.

In other words, this arrangement allows the release of air pressure 510 from the entrapped volume below the snout feature 118 during initial compression and capping. Preferably, the depth of the channels 550 are configured so that when fully capped, there is an air tight seal. As such, the depth of the channels 550 are preferably associated with the dimension of the seal 508 when the snout feature 118 mates with the seal 508. This allows a reduction in air pressure 510 in the cap 128 during the initial capping process, avoiding unnecessary depriming of the printhead assembly 100. In an alternative embodiment of FIGS. 5, 6, 7A and 7B, the vent paths remain slightly open to provide a vent channel to the surrounding atmosphere to accommodate changes in the environment, for example, when traveling to different altitudes.

Also, the caps 128 of the embodiments of FIGS. 4, 5, 6, 7A and 7B each preferably have a venting system that allows the respective capping systems to ingest or expel air as necessary while protecting ink against excessive water loss due to evaporation. The venting system can be any suitable, such as those found in U.S. Pat. Nos. 5,867,184, 5,712,668, 5,216,449, 5,146,243 and 5,448,270, all assigned to Hewlett-Packard Company, the current assignee.

What is claimed is:

1. A capping station for a fluid ejection device having a snout feature, the capping station comprising:

a cap with a rigid body and a gland seal disposed around an inner perimeter of a cavity defined by the rigid body for resiliently receiving side portions of the snout feature of the fluid ejection device to create a seal with the fluid ejection device.

2. The capping station of claim 1, further comprising a molded portion located between the gland seal and the inner perimeter of the cavity.

3. The capping station of claim 1, wherein the molded portion is made of a soft elastomer.

4. The capping station of claim 2, wherein the gland seal is overmolded soft elastomer.

5. The capping station of claim 4, wherein the seal is created by capturing a piece of the soft elastomer between the side portions of the snout feature and the seal, wherein a difference in radial dimensions are smaller than a cross sectional diameter of the seal.

6. The capping station of claim 5, wherein the side portions of the snout feature mate with the gland seal so that the seal is captured in a volume that has a smaller dimension than a cross sectional diameter of the seal.

7. The capping station of claim 1, wherein the gland seal includes notched channels incorporated at an edge of the seal that contacts with the side portions to allow air pressure to release from an entrapped volume below the snout feature during capping.

8. The capping station of claim 1, wherein the gland seal is a resilient angled seal with notches for resiliently receiving side portions of the snout feature of the fluid ejection device.

9. The capping station of claim 8, wherein the notches are located in a vertical plane to accommodate air pressure increase during capping.

10. A method for capping a fluid ejection device having a snout feature, the method comprising:

resiliently receiving side portions of the snout feature with a gland seal disposed around an inner perimeter of a cavity of a rigid body of a cap feature; and creating an out of plane seal with the gland seal.

11. The method of claim 10, further comprising forming an elastomer as the gland seal onto the inner perimeter of the cavity.

12. The method of claim 11, wherein the gland seal is an overmolded soft elastomer.

13. The method of claim 10, further comprising creating a seal by capturing a piece of the soft elastomer between the side portions of the snout feature and the gland seal.

14. The method of claim 13, further comprising mating the side portions of the snout feature with the gland seal so that the seal is captured in a volume that has a smaller dimension than a cross sectional diameter of the seal.

15. The method of claim 11, further comprising releasing air pressure from an entrapped volume below the snout feature during capping through notched channels defined by the gland seal which are incorporated at an edge of the seal that contacts with the side portions.

16. A capping station for a fluid ejection device having a snout feature, the capping station comprising:

a cap with a rigid body and an angled seal with notches for resiliently receiving side portions of the snout feature of the fluid ejection device.

17. The capping station of claim 16, wherein the notches are located in a plane of orifice plate to accommodate air pressure increase during capping.

18. The capping station of claim 16, wherein the angled seal controls capping forces while maintaining a seal when capped.

19. The capping station of claim 16, wherein the notches compress during engagement of the snout feature and allow the seal to resiliently contact the side portions for minimizing pressure against the fluid ejection device and on a carriage holding the fluid ejection device.

20. The capping station of claim 16, wherein the angled seal is a gland seal without notches disposed around an inner perimeter of a cavity of the rigid body for resiliently receiving side portions of the snout feature of the fluid ejection device to create an out of plane seal with the fluid ejection device.

21. The capping station of claim 16, wherein the capping station includes a venting system that allows the capping station to ingest or expel air as necessary while protecting fluid of the fluid ejection device against excessive water loss due to evaporation.

22. The capping station of claim 16, wherein the notches remain slightly open after capping to provide a vent channel to a surrounding atmosphere to accommodate environmental changes.

23. A capping station for a fluid ejection device having a snout feature, comprising:

means for resiliently receiving side portions of the snout feature with a gland seal disposed around an inner perimeter of a cavity of a rigid body of a cap feature; and means for creating an out of plane seal with the gland seal.

24. The capping station of claim 23, further comprising means for forming a soft overmolded elastomer as the gland seal onto the inner perimeter of the cavity.

25. The capping station of claim 23, further comprising means for creating a seal by capturing a piece of the soft elastomer between the side portions of the snout feature and the seal.

26. The capping station of claim 25, further comprising means for mating the side portions of the snout feature with the gland seal so that the seal is captured in a volume that has a smaller dimension than a cross sectional diameter of the seal.

27. The capping station of claim 23, further comprising means for releasing air pressure from an entrapped volume below the snout feature during capping through notched channels defined by the gland seal which are incorporated at an edge of the seal that contacts with the side portions.

28. An inkjet printing mechanism, comprising:

an ink supply;

an inkjet printhead having a snout feature and for dispensing ink from the ink supply; and a capping station including a cap with a rigid body and a gland seal disposed around an inner perimeter of a cavity defined by the rigid body for resiliently receiving side portions of the snout feature of the printhead to create a seal with the printhead.

29. The inkjet printing mechanism of claim 28, wherein the seal is created by capturing a piece of the seal between the side portions of the snout feature and the seal.

30. The inkjet printing mechanism of claim 28, wherein the side portions of the snout feature mate with the gland seal so that the seal is captured in a volume th at has a smaller dimension than a cross sectional diameter of the seal.

31. The inkjet printing mechanism of claim 28, further comprising a carriage supporting the printhead over a print media.

32. The inkjet printing mechanism of claim 28, further comprising a substrate having a front surface and an opposing back surface and ink ejection elements being formed on the front surface and the heat transfer device being in thermal contact with the back surface.

33. A method for capping a fluid ejection device having a snout feature with an orifice plate, the method comprising:

surrounding the snout feature; and capturing the orifice plate within a sealing chamber defined by an interior portion of a cap.

34. The method of claim 33, wherein the orifice plate is captured within the sealing chamber without contacting the orifice plate.

35. The method of claim 33, wherein capturing the orifice plate includes resiliently receiving side portions of the snout feature with a gland seal disposed around an inner perimeter of a cavity of a rigid body of a cap feature.

36. The method of claim 35, further comprising forming an elastomer as the gland seal onto the inner perimeter of the cavity.

37. The method of claim 36, further comprising creating a seal by capturing a piece of the gland seal between the side portions of the snout feature and the gland seal.

* * * * *